United States Patent [19]

Slezak

[11] Patent Number: 4,929,012

[45] Date of Patent: May 29, 1990

[54] CREEL LOADING APPARATUS

[75] Inventor: Raymond J. Slezak, Barberton, Ohio

[73] Assignee: RJS Corporation, Akron, Ohio

[21] Appl. No.: 193,355

[22] Filed: May 12, 1988

[51] Int. Cl.[5] ..... B66C 1/30

[52] U.S. Cl. ..... 294/86.41; 294/110.1; 294/115

[58] Field of Search ..... 294/93, 97, 86.41, 110.1, 294/115, 119.1, 106

[56] References Cited

U.S. PATENT DOCUMENTS

| | | | |
|---|---|---|---|
| 1,298,064 | 3/1919 | Lichtenthaeler | 294/106 |
| 1,807,360 | 5/1931 | Wehr | 294/106 |
| 2,216,676 | 10/1940 | Ragland | 294/115 X |
| 2,337,177 | 12/1943 | Breslav | 294/110.1 X |
| 2,364,897 | 12/1944 | Grigsby | 294/115 |
| 2,610,890 | 9/1952 | Jaeger | 294/110.1 X |
| 3,103,282 | 9/1963 | York | 294/106 |
| 3,582,128 | 6/1971 | Liege | 294/115 |

FOREIGN PATENT DOCUMENTS

| | | | |
|---|---|---|---|
| 1506525 | 7/1969 | Fed. Rep. of Germany | 294/106 |
| 2255865 | 5/1974 | Fed. Rep. of Germany | 294/106 |
| 388994 | 7/1973 | U.S.S.R. | 294/106 |
| 626012 | 9/1978 | U.S.S.R. | 294/106 |
| 706308 | 1/1980 | U.S.S.R. | 294/106 |
| 1381057 | 3/1988 | U.S.S.R. | 294/86.41 |

*Primary Examiner*—Margaret A. Focarino

*Assistant Examiner*—Gary C. Hoge

*Attorney, Agent, or Firm*—Renner, Kenner, Greive, Bobak, Taylor & Weber

[57] ABSTRACT

A loading chuck (25) suspended by a cable (C) for grasping a spool (S), including strand material (M) disposed thereon between the flanges (14, 15) thereof, in a container, transporting the spool to a position proximate a creel and orienting the spool for positioning on a creel spindle, includes a plurality of substantially parallel arms (50), shoes (60) carried by the arms, gripping elements (61; 80, 80') on the shoes for engaging the spool, a lifting link (20) adapted for attachment to the cable, a linkage (26) interposed between the lifting link and the arms and maintaining the arms substantially parallel through the extent of travel thereof to bring the gripping elements into and out of engagement with the spool, and a pivot (55) mounting the shoes relative to the arms for selectively rotationally orienting the spool. Another embodiment contemplates loading apparatus (110) mounting a plurality of chucks (125) including a support (120) attached to a lifting link, a plurality of blocks (130, 131) mounted on the support, each of the blocks carrying one of the chucks, a mechanism (135) selectively moving at least some of the blocks along the support for varying the distance between the chucks, and a chuck rotating mechanism (150, 151) for coordinated equiangular rotation of the chucks.

11 Claims, 6 Drawing Sheets

C
17
22
20
10
25
46
30
21
28
30
28
30
30
2
2
35
41
41
27
26
40
45
43
36
40
35
4
4
42
27
43
42
41
23
41
3
3
26
29
29
30
81
80
80
71
82
66
69
67
15
68
74
65
70
72
73
M
50
52
51
58
55
56
57
60
82'
81'
80'
14
12
13
S

CREEL LOADING APPARATUS

TECHNICAL FIELD

The invention relates generally to creel loading apparatus. More particularly, the invention relates to a loading machine for grasping, transporting, and positioning spools of steel cord or other material in a creel. More specifically, the invention relates to a grasping device for spools of steel cord or other material which grips one or more spools in a container for transport into proximity with a selected spindle or spindles of an array of spindles and to facilitate positioning of spools on selected spindles.

BACKGROUND OF THE INVENTION

There are various types of manufacturing processes which involve the combination of a plurality of strands of material which during processing are combined with each other, with other materials or both. Where it is necessary to combine a plurality of such strands of material during either continuous or intermittent manufacturing operations, it is frequently convenient that the strands be coiled such as to provide the capability of continuously feeding out substantial lengths of the strands. In order to have available in a manageable form substantial lengths of coiled strands it is commonly known to employ spools upon which the coiled strands are mounted for storage and from which the strands may be paid out by rotation of the spools about the longitudinal axis thereof.

One such example of the employment of spools to store and pay out strands is involved in the rubber industry where it is common to simultaneously employ a plurality of steel cords which are stored on and dispensed from spools. The spools are normally mounted in an array which is commonly referred to as a creel. While creels may differ in various details they commonly consist of an array of spindles which are mounted in a substantially vertical frame work having spindles which may project in both directions therefrom. The spools typically have a diameter of approximately ten inches and a longitudinal dimension of a foot, although other dimensions are employed in some instances. The spools have a hollow core which inwardly receives a creel spindle and which outwardly carries steel cord or other material repetitively coiled within the confines of the spool flanges. Creels commonly array the spindles in rectangular configurations projecting from the framework in arrangements which may conveniently have six spindles high and a multitude of spindles long or in some instances five spindles high and a multitude of spindles long. This type of arrangement places spindles from a position just above the ground to approximately six feet off the ground taking into account the necessary spacing between spindles as a result of the diameter of the spools which may be on the order of ten inches and of the necessary spacing between spindles to effect requisite control over pay out and tensioning of the strands.

Spools employed for steel cord are normally of a construction such that while the spool is of relatively light metal material the full spool with its capacity of steel cord approaching the radially outer extremity of the flanges may weigh on the order of forty to eighty pounds. The spools are normally packaged in standard rectangular shipping containers or cartons in which the spools are tightly packed in circumferential engagement with adjacent spools with the core or longitudinal axis vertically aligned. Cartons are commonly sized such as to receive three spool by four spool layers arranged in three layers constituting a total of 36 spools. In some instances, the containers may accommodate 72 spools having a reduced axial length.

In many manufacturing operations the cartons or containers are positioned proximate to the creels and an operator manually removes empty spools from the spindles and replaces them with full spools of steel cord. While manual loading of the creels is possible, it has the disadvantage that over the period of a work day a creel operator may become sufficiently fatigued, particularly in relation to the placement of spools on the higher spindles, that the overall loading time for creels may become excessively long. In addition, the size and strength of a creel operator becomes highly significant in effecting the loading of spools over a period of time. In order to attempt to obviate a high degree of reliance on the size and strength of creel operators, efforts have been made to employ hoists to facilitate the lifting of individual spools. In this regard, the packaging of the spools in rectangular shipping containers becomes a significant factor. In particular, grasping devices employed with hoists have been constructed to engage either the upper flange of the spools or the opening in the hollow core of the spools; however, the grasping of the spools in this fashion has certain undesirable implications. In either instance where a spool is grasped by either the central opening or the flange, it is necessary that the flange of the spool opposite the flange being gripped be inserted onto the spindle. Since the spools on one side of a creel commonly rotate in one direction to pay out cord and spools on the other side or on other creels may rotate in the opposite direction, it is necessary that spools be double handled or the container of spools be inverted in order to effect loading in all situations with end gripping apparatus of this type. The flange gripping hoist devices have the additional disability that with the grasping of one flange and the relatively flimsy construction of the spool flanges, a spool may be distorted or damaged to such an extent that it will not operate properly on a creel spindle or is incapable of being securely retained by such hoist gripping devices. As a result of these various problems attendant efforts to partially mechanize the loading of spools on a creel, there remain substantial numbers of installations which are manually loaded or where hoist assisted grasping devices are employed only a portion of the time or by some operators. Certainly no single creel loading device has proved to have sufficient capability and flexibility to gain wide acceptance in the handling of spools of substantial weight such as those employed to coil steel cord.

DISCLOSURE OF THE INVENTION

Therefore an object of the present invention is to provide creel loading apparatus suitable for usage with a hoist to constitute a semi-automatic creel loading machine. Another object of the present invention is to provide such creel loading apparatus which is adapted to be employed as part of a creel loading machine wherein the creel loader may move in a pre-programmed sequence from a container for spools to a particular creel spindle back to the container at the location of a different spool, to a different spindle and similarly repetitively until a container is empty or all spindles of a creel are loaded with spools. Yet another object of the present invention is to provide such creel loading apparatus which will fully accommodate spools for steel cord, shipping cartons therefor and creel spindles of a type and arrangement in accordance with normal industry practices.

Yet another object of the present invention is to provide creel loading apparatus having a chuck which is capable of gripping a spool at any location in a standard spool shipping container. Yet another object of the present invention is to provide such a chuck which upon gripping a spool in a shipping container can remove the spool from the container by vertical motion without interfering with the container or other spool therein. Still another object of the present invention is to provide such a chuck which is capable of gripping a spool in two different ways to satisfy varying operating requirements which may be necessary in different installations. Yet another object of the present invention is to provide such a chuck which has shoes adapted to engage the steel chord on the spool to obviate the possibility of damage to the spools and particularly the flanges thereof. Still a further object of the present invention is to provide such a chuck which may be provided with fingers adapted to engage the flanges at either axial extremity of a spool to thereby distribute the weight between a plurality of locations to minimize the possibility of damage to the spools.

Yet another object of the present invention is to provide creel loading apparatus including a chuck having shoes which engage the spools such that the shoes rotate to rotationally orient the spool relative to the chuck. A further object of the present invention is to provide such a chuck wherein the shoes are mounted in the chuck and engage the spools in such a manner that the axis of rotation of the shoes and the center of gravity of the spools are substantially aligned, whereby shoes carrying a spool substantially maintain any rotational position in which the spool may be placed. Another object of the present invention is to provide such a chuck and chuck shoe engagement of spools such that either axial extremity of a spool may be inserted on a spindle of a creel.

Yet another object of the present invention is to provide creel loading apparatus wherein the chucks are provided with suitable linkage mechanism such that substantially parallel arms carrying similarly disposed shoes are moved in parallel relationship into and out of engagement with the spool flanges or the strand material which is positioned on the spool. Yet another object of the present invention is to provide such a chuck having such a linkage wherein the weight of the spool operates to intensify the grasping of the spool by the engaging shoes on the chuck.

A further object of the invention is to provide a second embodiment of the creel loading device of the present invention wherein a mounting assembly is capable of suspending and manipulating two, three or more chucks such as to simultaneously grip and remove a comparable number of spools from a shipping container and thereafter simultaneously position said spools in proximity to an equal number of spindles for essentially simultaneous positioning thereof. Yet another object of the present invention is to provide such a multiple chuck loading device which provides biasing action to selectively bring the chuck shoes into engagement with a spool and to facilitate the opening of the shoes as manually controlled by an operator of the creel loading apparatus. Yet a further object of the present invention is to provide such a multiple chuck loading device wherein the axes or center lines of the chucks may be moved from the spaced distance between the center lines of spools in a shipping container to the spaced distance between adjacent spindles of a creel. A still further object of the invention is to provide such a multiple chuck loading device wherein the chucks may be selectively simultaneously rotated about their axes or center lines from an angular orientation for fitting between and picking up spools in a shipping container to an angular orientation for pivoting the chuck shoes relative to the chuck arms to orient the spools for insertion on the spindles of a creel.

Yet another object of the present invention is to provide creel loading apparatus which is relatively noncomplex, which employs a combination of reliable components and combination thereof and which can be readily operated by virtually any worker having normal size, strength, and manual dexterity. Another object of the present invention is to provide creel loading apparatus for usage with a conventional hoist or a programable hoist to provide relatively inexpensive semi-automatic loading of spools from shipping containers to creel spindles. Yet a further object of the invention is to provide such creel loading apparatus which is capable of handling one or a plurality of spools at a time and is capable with minimal modification of conversion from single to multiple spool handling capabilities.

In general, the present invention contemplates a loading chuck suspended by a cable for grasping a spool, including strand material disposed thereon between the flanges thereof, in a container, transporting the spool to a position proximate a creel and orienting the spool for positioning on a creel spindle and includes a plurality of substantially parallel arms, shoes carried by the arms, gripping elements on the shoes for engaging the spool, a lifting link adapted for attachment to the cable, a linkage interposed between the lifting link and the arms and maintaining the arms substantially parallel through the extent of travel thereof to bring the gripping elements into and out of engagement with the spool, and a pivot mounting the shoes relative to the arms for selectively rotationally orienting the spool. The second embodiment of the present invention contemplates loading apparatus mounting a plurality of the aforesaid chucks including a support attached to a lifting link, a plurality of blocks mounted on the support, each of the blocks carrying one of the chucks, a mechanism selectively moving at least some of the blocks along the support for varying the distance between the chucks, and a chuck rotating mechanism for coordinated equiangular rotation of the chucks.

PREFERRED EMBODIMENT FOR CARRYING OUT THE INVENTION

Figure 1:
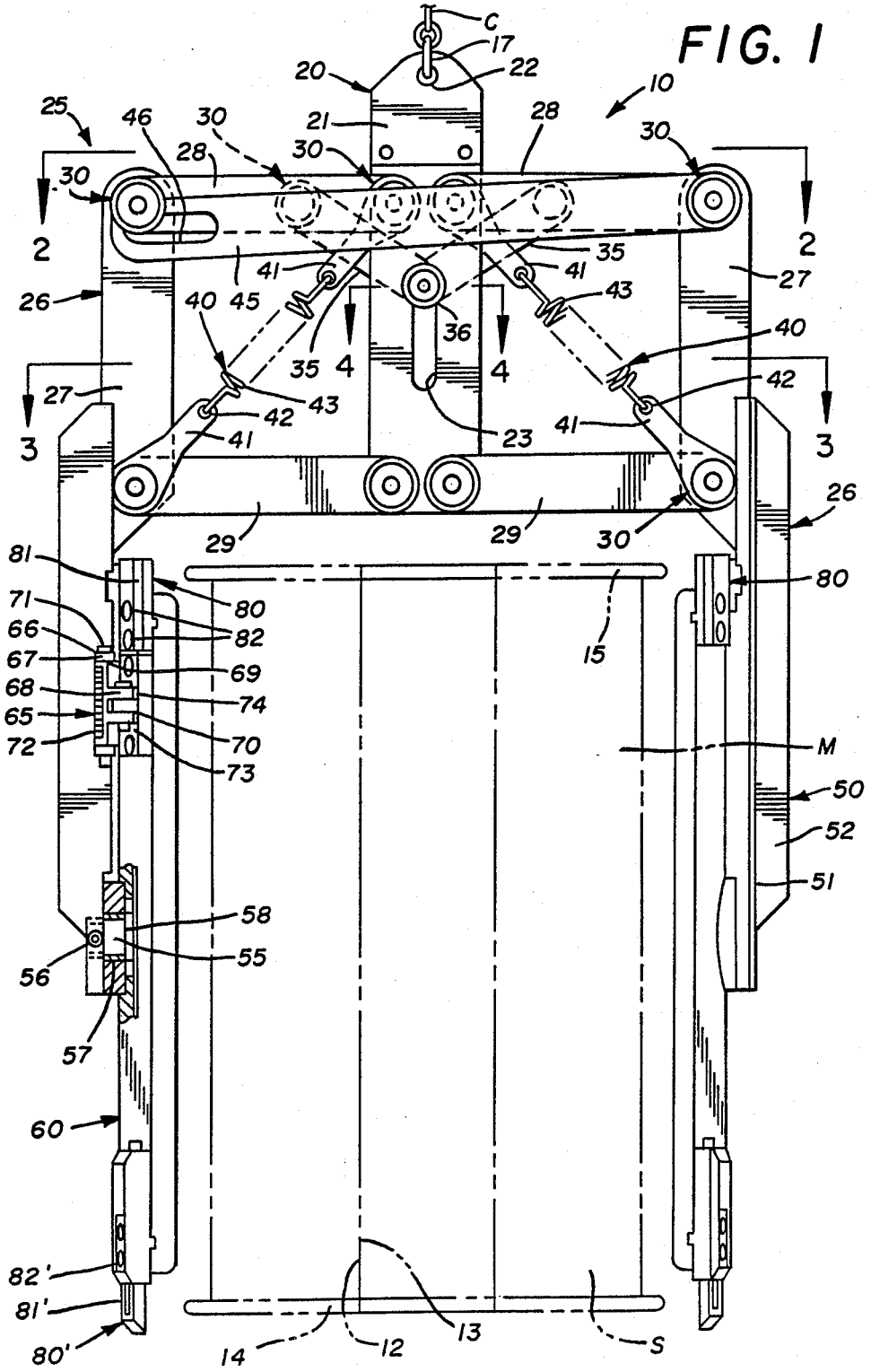
FIG. 1 is a front elevational view with parts broken away and shown in section of creel loading apparatus embodying the concepts of the present invention and having a single chuck depicted in the locked open position for encompassing preparatory to grasping a spool having its axis vertically positioned.

Exemplary creel loading apparatus embodying the concepts of the present invention is generally indicated by the numeral 10 in FIG. 1 of the drawings. The creel loading apparatus 10 is adapted to handle a single spool S of the type generally depicted in chain lines in FIGS. 1 and 5 of the drawings. As shown for exemplary purposes in the drawings, the spool S has a hollow core 12 which defines a central opening 13 that is adapted to receive a spindle of a conventional creel in the instance of a rubber industry application. The longitudinal extremities axially of the spool S are defined by flanges 14 and 15. Disposed about the core 12 and within the confines of the flanges 14, 15 is strand material M which may be steel cord or other material depending upon the application involved in the manufacturing process. The strand material M is wound about the core 12 of spool S until a level is reached which is preferably proximate to but at least slightly radially below the radial outer extremities of the flanges 14, 15. This normal level of strand material M on spool S is significant in one of the two manners by which the creel loading apparatus 10 grips the spool S for the handling contemplated by creel loading apparatus 10.

The creel loading apparatus 10 according to the present invention contemplates the use of a hoist (not shown) which may advantageously be capable of moving creel loading apparatus 10 according to either manually controlled or preprogrammed three-axis motions to effect the lifting functions required for the grasping and pick up of a spool S in a shipping container, transporting of the spool S to a position proximate the spindle of a creel for manual placement of the central opening 13 of the spool S on a creel spindle. Whichever type of hoist system and control may be employed, the creel loading apparatus 10 is suspended from the hoist by an interconnecting cable C which may also be a chain or rigid rod.

Figure 3:
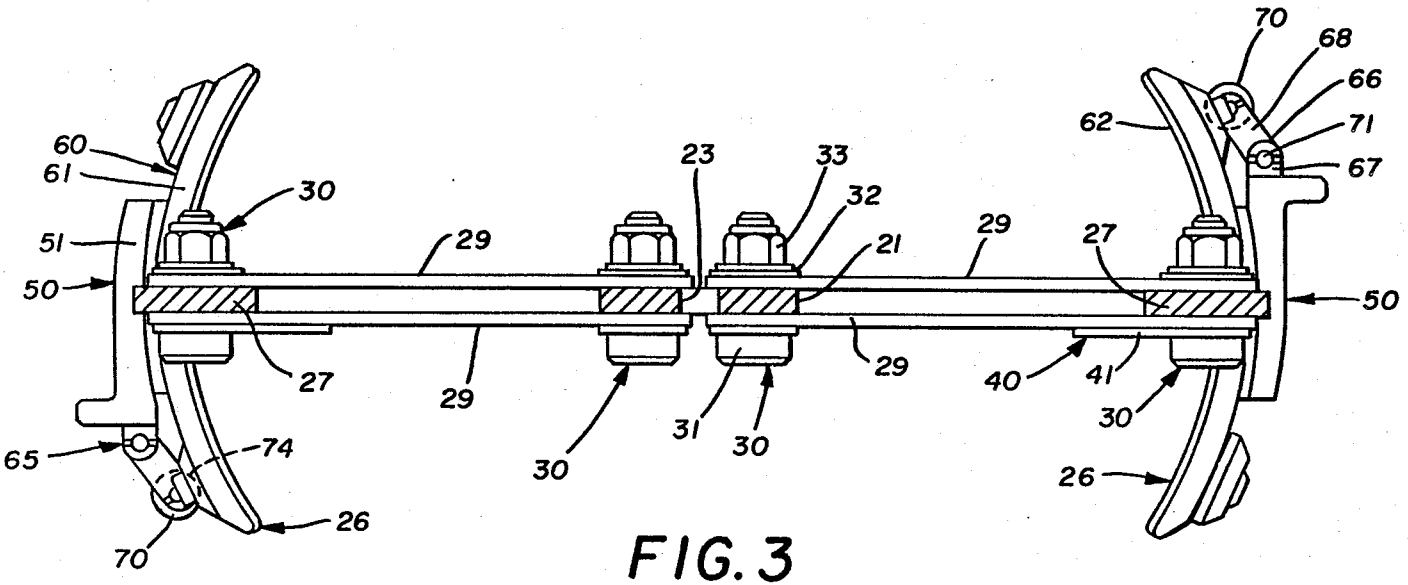
FIG. 3 is a sectional view of the chuck of the loading device of FIG. 1 taken substantially along the line 3—3 thereof.
Figure 4:
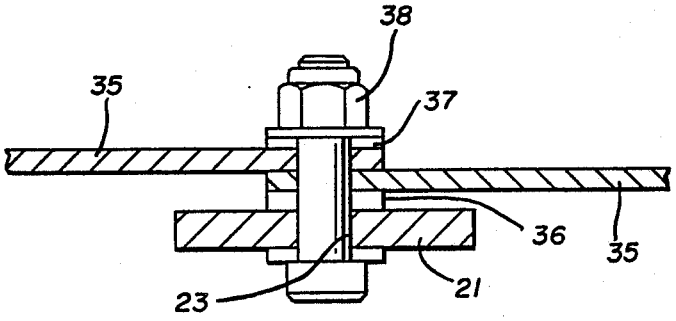
FIG. 4 is a fragmentary sectional view of the chuck of the loading device of FIG. 1 taken substantially along the line 4—4 of FIG. 1.

The loading apparatus 10 has as the member interfacing with the cable C a lift link assembly, generally indicated by the numeral 20, seen in FIG. 1. As shown, the lift link assembly 20 consists of a rectangular, vertically disposed link bar 21. The link bar 21 of lift link assembly 20 preferably has proximate its upper extremity an eye 22 which is adapted to receive a connector such as clevis 17 for interconnecting link bar 21 with the cable C. The link bar 21 is provided with a longitudinal slot 23 over a portion of the length thereof as best seen in FIGS. 1, 3, and 4 of the drawings for a purpose to be hereinafter described.

Figure 2:
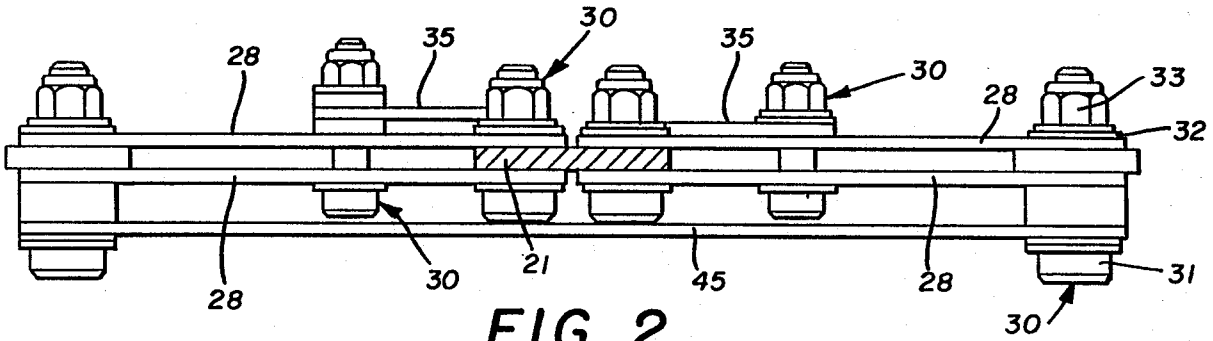
FIG. 2 is a sectional view of the chuck of the loading device of FIG. 1 taken substantially along the line 2—2 thereof.

Operatively interrelated with and suspended from the lift link assembly 20 is a chuck assembly, generally indicated by the numeral 25. The chuck assembly 25 has disposed from the lift link assembly 20 in opposed directions two preferably identical parallelogram linkages, generally indicated by the numeral 26. Referring to FIGS. 1 and 2 of the drawings, the parallelogram linkages 26 each have an arm link 27 which is spaced a distance laterally of the lift link assembly 20. Each arm link 27 is spaced from and joined to the link bar 21 of lift link assembly 20 by a pair of parallel upper connecting links 28 (see FIGS. 1 and 2) and a pair of parallel lower connecting links 29 (see FIGS. 1 and 3). The upper connecting links 28 and lower connecting links 29 are each rotatably attached to the link bar 21 at one extremity and to the arm link 27 at the other extremity by pivot joints 30. The pivot joints 30, as seen in FIGS. 2 and 3, each consist of a bolt 31, a thrust bearing race 32 and a self-locking nut 33.

The parallelogram linkages 26 of chuck assembly 25 are interconnected to produce identical coordinated movement of the two link arms 27 by a pair of interconnect links 35. The interconnect links 35 each have one extremity thereof connected to the upper connecting links 28 at a position intermediate the extremities thereof and the other extremity interconnected with a pivot joint 36 which as best seen in FIG. 4 may be a suitable bolt. The attachment of the inter connect links 35 to the upper connecting links 28 may be by a pivot joint 30 of the type mounting connecting links 28, 29 described above. The pivot joint 36, as seen in FIG. 4, is provided with an appropriate thrust bearing race 37 and a self-locking nut 38. The pivot joint 36 freely pivotally mounts each of the links 35 and is free for vertical displacement within the slot 23 of link bar 21 to thus coordinate the movement of the two arm links 27.

Each parallelogram linkage 26 is biased toward maintaining the rectangular position thereof depicted in FIG. 1 of the drawings by a spring assembly, generally indicated by the numeral 40. As shown in FIGS. 1 and 3, the spring assemblies 40 are disposed diagonally of the parallelogram linkage 26 between pivot joints 30 as by mounting on bolts 31. As shown, these bolts 31 mount spring hangers 41 having eyes 42 between which torsion springs 43 are interposed. Thus, the torsion springs 43 tends to resist to an extent the tendency of arm links 27 to be displaced downwardly due to the action of gravity on the parallelogram linkages 26 and related components.

The parallelogram linkages 26 are selectively maintained in the rectangular configuration depicted in FIG. 1 of the drawings by a latch link 45. The latch link 45 extends between the two pivot joints 30 at the upper extremities of the arm links 27, as best seen in FIGS. 1 and 2. One end of the latch link 45 is bored to receive machine screw 31 of pivot joint 30. The other extremity of latch link 45 has an L-shaped slot 46 which encompasses and rides on the bolt 31 of the other pivot joint 30. It will thus be noted that both parallelogram linkages 26 are locked in the rectangular configuration with the latch link 45 accommodating bolt 31 in the vertical leg of slot 46 as depicted in FIG. 1 of the drawings. When the latch link 45 is moved upwardly from the position shown in FIG. 1 to the unlocked position (see FIG. 9) the bolt 31 is free to slide in the horizontal portion of slot 46, thereby permitting the arm links 27 to move vertically downwardly and radially inwardly as equalized by the interconnect links 35.

Figure 5:
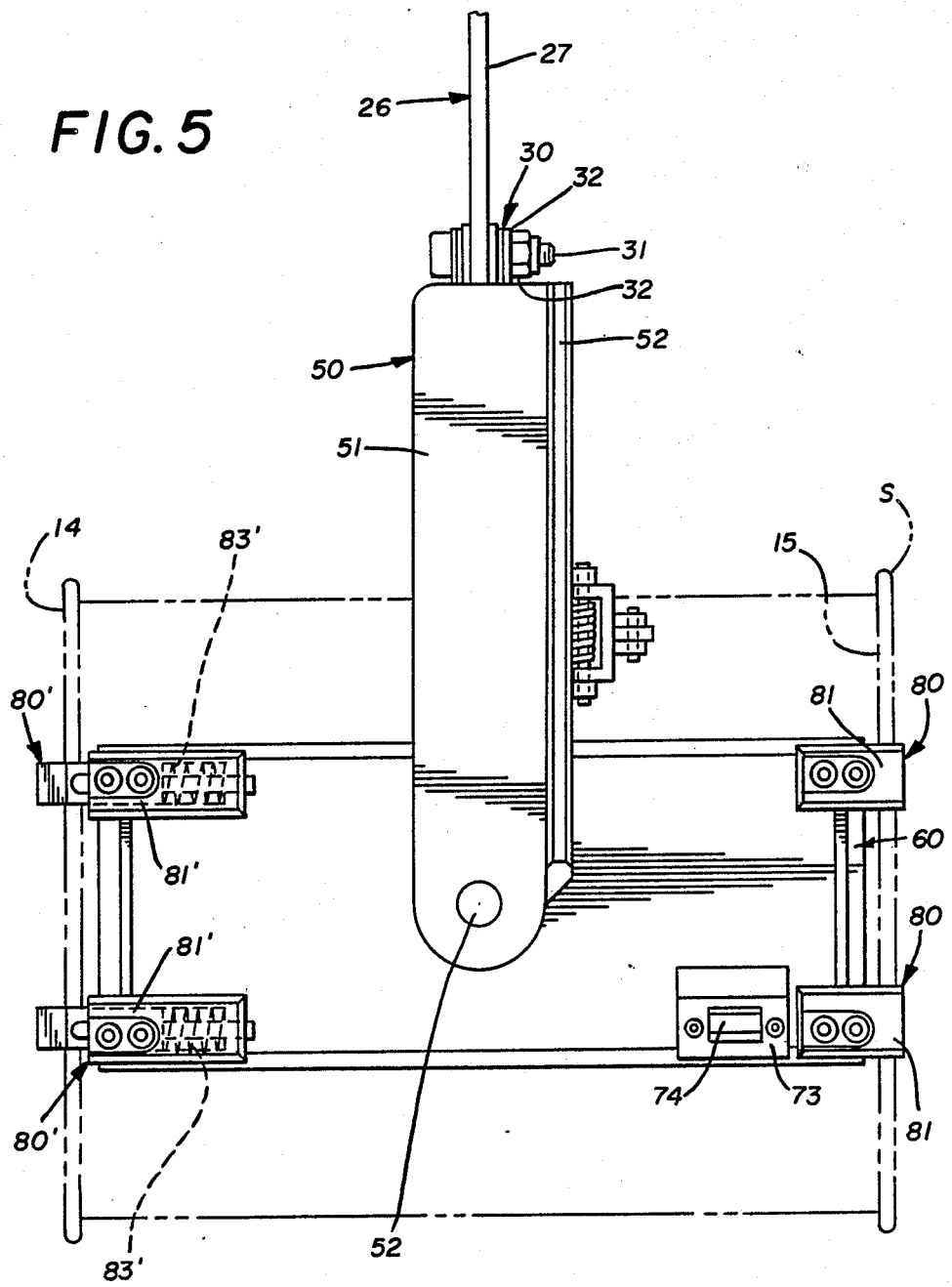
FIG. 5 is a side elevational view of the loading device of FIG. 1 depicting an arm and shoe of the chuck of FIG. 1, with the shoe being rotated through an angle of 90° relative to the arm such that the spool has its axis substantially horizontally oriented for positioning on a spindle.

Rigidly attached to and movable with each arm link 27 of each parallelogram linkage 26 is an arm assembly, generally indicated by the numeral 50 as seen in FIGS. 1, 3 and 5. Each arm assembly 50 consists of an arm plate 51 which is an elongate member extending downwardly from the link arm 27 and which may be slightly curved in cross section as best seen in FIG. 3. At least one lateral extremity of arm plate 51 may have an integral stiffener projection 52 which imparts longitudinal rigidity to the arm plate 51. Mounted preferably proximate the lower extremity of arm plate 51 is a pivot pin 55. The pivot pin 55 may be affixed to arm plate 51 as by a set screw 56. The pivot pin 55 may be mounted in a cup bearing 57 and have a thrust bearing 58 at the axial extremity thereof.

Rotationally mounted on pivot pin 55 of arm plate 51 of arm assembly 50 is a shoe assembly, generally indicated by the numeral 60. The shoe assembly 60 includes a longitudinally elongate shoe plate 61 (FIGS. 3 and 5). The shoe plate 61 is of such a length as to extend a substantial portion of the axial dimension of a spool S but remain of a lesser dimension than the axial dimension between the flanges 14, 15 of the spool S, even in the event that one or both flanges should be slightly axially deflected due to dropping or other mishandling. The shoe plate 61 is preferably laterally curved on a radius such as to circumferentially matingly engage a portion of the circumference of the strand material M disposed on a spool S between the flanges 14, 15. With the shoe plates 61 in opposed relation as depicted particularly in FIG. 3, a spool S disposed therebetween has the radially inner surface of shoe plates 61 engaging diametrically opposite portions of a spool S. The shoe plates 61 may have a cover 62 of thin elastomeric material affixed, as by an adhesive, over all or a portion of the radially inner surface thereof for purposes of improving the grip of the shoe plates 61 on the strand material M and preventing abrading of the strand material M. Thus the usage of the cover 62 and the configuration of the shoe plates 61 provide one form of gripping of a spool S by the chuck assembly 25.

It is to be noted that the longitudinal extent of the shoe plates 61 above and below the mounting on the pivot pins 55 is advantageously substantially equivalent. Since shoe plates 61 just interfit within flanges 14, 15 of a spool S and are thus positioned substantially medially therebetween, it will be seen that the center of mass and therefore the center of gravity of a spool S will be positioned substantially in alignment with the pivot pins 55. From this it will be appreciated that with the chuck assembly 25 loaded with a spool S the shoe assemblies 60 may be rotated to any position relative to the arm assemblies 50 and remain rotationally at rest in said position due solely to the normal friction involved in bearings 57, 58 surrounding the pivot pin 55. Thus, in the process of inserting a spool S on a creel spindle, a spool S positioned on shoe assembly 60 as depicted in FIG. 5 with the spool S having its axis substantially horizontally oriented will maintain the selected position without tending to rotate about pivot pin 55, yet permit easy rotational adjustment by an operator.

In the instance of the vertical positioning of the shoe assemblies 60 as during the positioning of chuck assembly 25 about a spool S in a shipping container it is advantageous that the shoe plates 61 not be prone to rotation due to minor forces which may be encountered in endeavoring to align the center line of the chuck assembly 25 with the center line of a spool S. In particular, slight misalignment could result in one or both of the shoe plates 61 of a chuck assembly 25 by engaging or bumping a spool S which is being picked up, adjacent spools or the shipping container. Therefore, for purposes of maintaining the shoe plates 61 in the vertical position depicted in FIG. 1 of the drawings despite minor forces tending to displace it therefrom, there is provided a catch assembly, generally indicated by the numeral 65 in association with at least one and preferably both arm assemblies 50 of each chuck assembly 25. The catch assembly 65 is positioned partially on the arm plate 51 and partially on shoe plate 61 a distance displaced from the pivot pin 55.

As shown in FIGS. 1 and 3, the catch assembly 65 includes a hinge 66 mounted on the arm plate 51. The hinge 66 includes knuckle portions 67 which are attached to the shoe plate 61. A moving hinge plate 68 having knuckles 69 is bifurcated to mount a roller 70. The knuckles 69 are located concentrically with the knuckles 67 and pivotally joined by a hinge pin 71. A torsion spring 72 is arranged to bias the hinge plate 68 and thus bias the roller 70 radially inwardly of chuck assembly 25 as viewed in FIG. 3 of the drawings. The shoe plate 61 has a detent 73 rigidly mounted thereon. The detent 73 includes a depression 74 adapted to generally conform to the roller 70. The roller 70 and detent 73 are positioned such that the roller 70 is aligned with and biased into the depression 74 in detent 73 when the shoe plates 61 are exactly vertically oriented as for the pick-up of a spool S. While the catch mechanism 65 maintains the shoe plate 61 vertically aligned during pick up and transport of a spool S, a minimal rotational force applied to a shoe plate 61 or a spool S engaged thereby will move the roller 70 out of depression 74 in detent 73 and thus permit the selective rotational positioning of the shoe plates 61 and a spool S, as for deposit on a creel spindle as described hereinabove.

As an alternative to the use of shoe plate 61 and cover 62 to engage a spool S, the shoe plates 61 may be provided with upper finger assemblies 80 and lower finger assemblies 80'. As best seen in FIGS. 1 and 5 the upper finger assemblies 80 may be fixed fingers 81 which may be positioned on the radially outer side of the shoe plates 61. The fingers 81 support the radially outer extremity of the upper flange 15 of a spool S. The fingers 81 may be fixed to the shoe plate 61 as by machine screws 82. The lower finger assemblies 80' have fingers 81' which extend from a housing 82' having a compression spring 83' therein. The compression spring 83' urges the fingers 81' out of the housing 82' to an extended position essentially as depicted in FIGS. 1 and 5 of the drawings with the lower flange 14 of the spool S being supported by the fingers 81'. The lower fingers 81' are retractable from the extended position of FIG. 1 for purposes of permitting a sufficient lowering of the shoe assemblies 60 such that the upper flange 15 of spool S can be positioned above the shoe plates 61 in engagement with the fingers 81. Thus, the retractable fingers 81' are of significance in situations where a flange 14, 15 of a spool S might be damaged, distorted, or have variations in spool length such that the chuck mechanism 25 must be lowered to an extent that retraction of fingers 81' is necessary in order to permit flange 15 of a spool S to be positioned above shoe plate 61 and in engagement with the fingers 81 as depicted in FIG. 1 of the drawings.

The operation of the creel loading apparatus 10 will be essentially apparent to persons skilled in the art based upon the above description of the structure and function of the components. It is to be noted that the chuck assembly 25 is lowered into gripping relation with a spool S with the latch link 45 in the locked position depicted in FIG. 1 of the drawings to provide suitable clearance with respect to the flanges 14, 15 of a spool S. With the shoe assembly 60 positioned in relation to a spool S substantially as depicted in FIG. 1 for gripping by the shoe plate 61 with cover 62 or the finger assemblies 80, 80', the latch link 45 is moved vertically upwardly to release. Thereafter, upon upward movement of the creel loading apparatus 10 as effected by take up of the hoist controlling the cable C, the shoe assemblies 60 move inwardly to grasp the strand material M on spool S or the flanges 14, 15 thereof, as provided. During lifting it will be appreciated that the weight of the spool S merely intensifies the gripping of spool S by the shoe assemblies 60. Once the creel loading apparatus 10 transfers a spool S to a position proximate a creel spindle and it is rotationally oriented to the horizontal position of FIG. 5, the spool S is manually started on the spindle. At this time the lifting force applied through cable C is reduced so that the shoe assemblies 60 release the grip on spool S. The chuck mechanism 25 may have the shoe assemblies 60 further opened by the operator grasping one of the lower connecting links 29 to return parallelogram linkages 26 toward the rectangular position depicted in FIG. 1, which movement is assisted by the spring assemblies 40 which effectively operate as a counterbalance. Once the parallelogram linkage 26 assumes the rectangular configuration of FIG. 1 of the drawings, the latch link 45 moves into the locked position in the vertical portion of slot 46 to thereby lock shoe assemblies 60 in the position of FIG. 1 ready for return to the location of a spool container and the subsequent pick up and delivery of another spool S.

Figure 6:
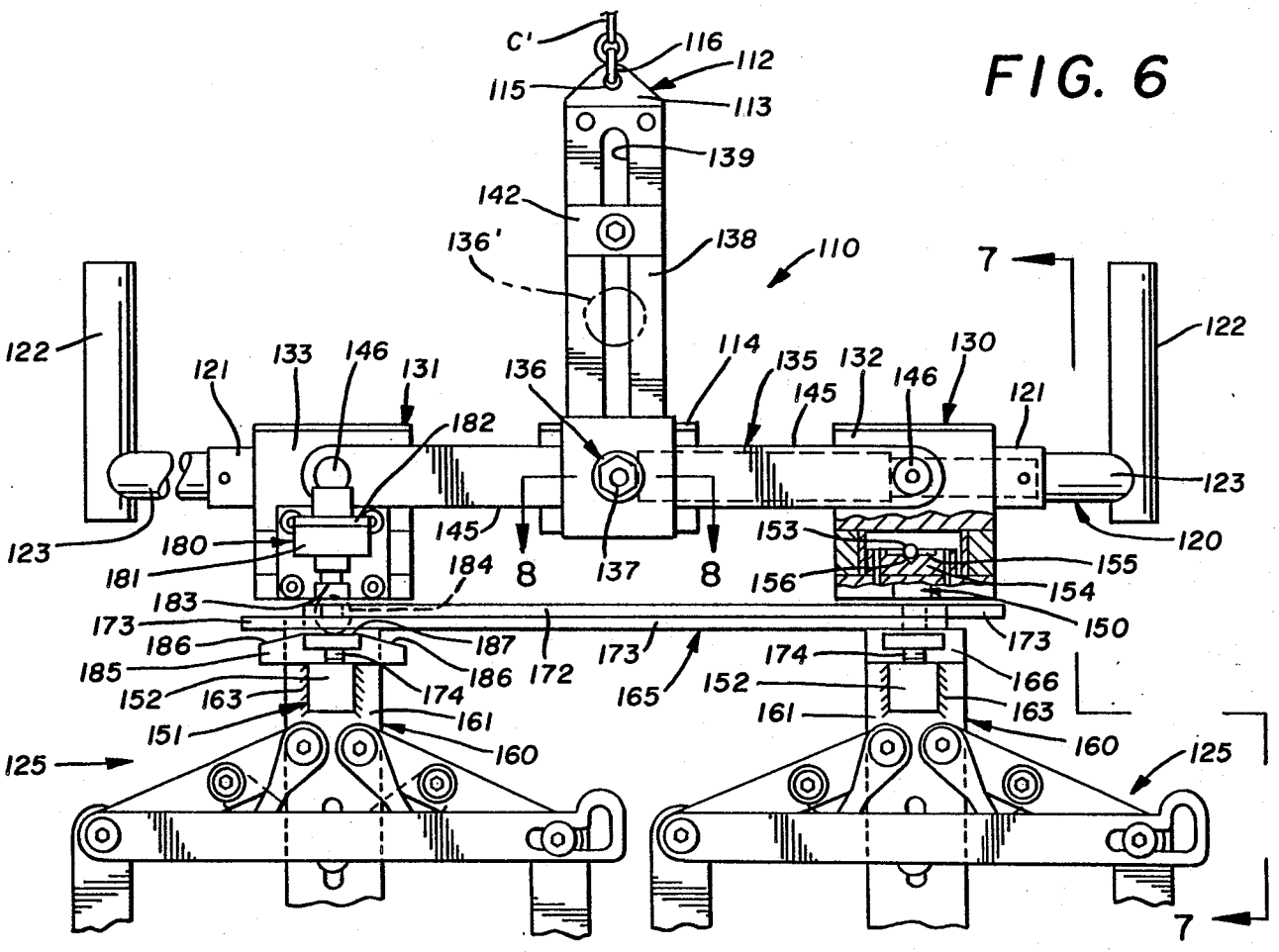
FIG. 6 is a fragmentary front elevational view of a second embodiment of the creel loading device of the present invention showing particularly a multiple chuck mounting assembly for positioning and manipulating in this instance a pair of chucks.

Exemplary creel loading apparatus according to the concepts of the second embodiment of the present invention is generally indicated by the numeral 110 in FIG. 6 of the drawings. The creel loading apparatus 110 is adapted to handle a plurality of spools S of the type depicted and described above in relation to FIGS. 1 and 5 of the drawings. As shown, the creel loading apparatus 110 employs multiple chucks and in the particular embodiment shown, two chuck assemblies 125. The chuck assemblies 125 are only partially depicted inasmuch as each chuck assembly 125 may be identical to the chuck assemblies 25 described hereinabove.

In a manner similar to creel loading apparatus 10, the creel loading apparatus 110 contemplates the use of a hoist (not shown) which may be controlled as previously specified to effect the various functions for loading a creel as described in conjunction with the creel loading apparatus 10 except that in the instance of creel loading apparatus 110 two spools S are simultaneously identically handled by the two chucks 125, 125 throughout the operating cycle. Whatever type of hoist system and controls are employed, the creel loading apparatus 110 is suspended from the hoist by an interconnecting cable C'.

Figure 7:
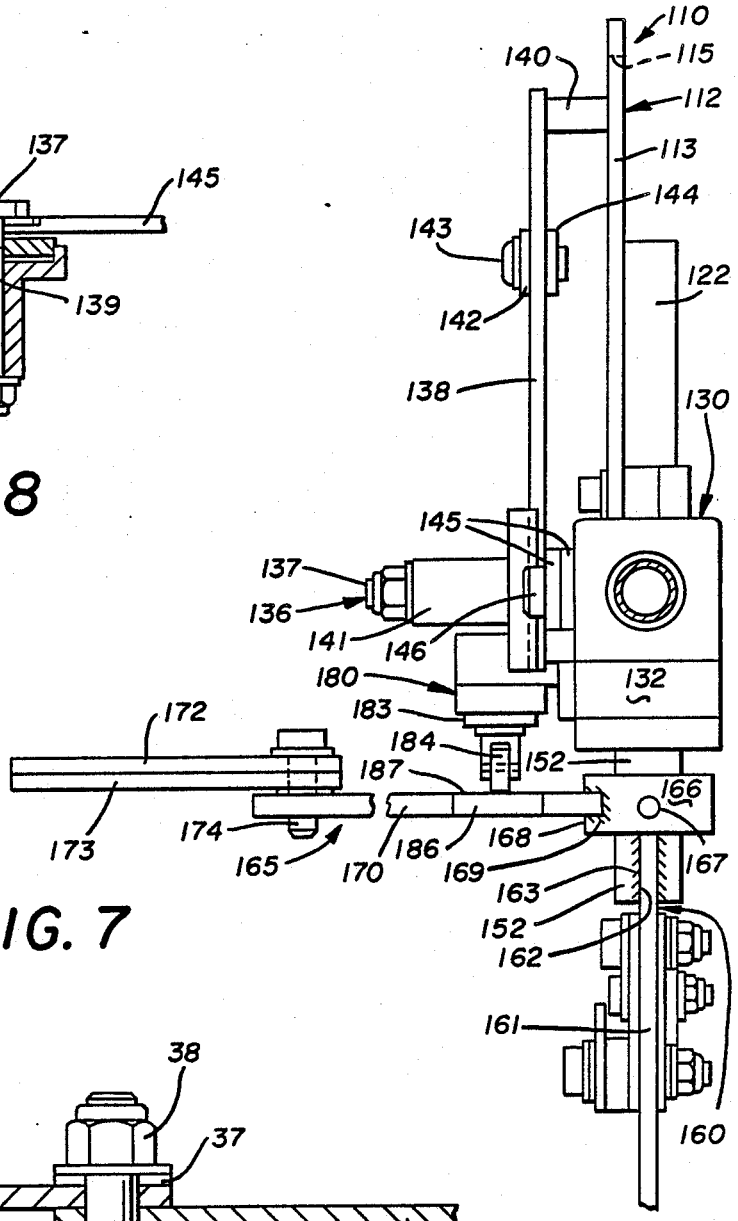
FIG. 7 is a fragmentary side elevational view partly in section of the creel loading device of FIG. 6 taken substantially along the line 7—7 of FIG. 6.

The loading apparatus 110 has as the member interfacing with the cable C' a suspension assembly, generally indicated by the numeral 112. As seen in FIGS. 6 and 7, the suspension assembly 112 includes a rectangular, vertically disposed link bar 113 which has an anchor block 114 mounted at the lower extremity thereof. The link bar 113 preferably has proximate the upper extremity an eye 115 which is adapted to receive a connector such as a clevis 116 for interconnecting the link bar 113 with the cable C'.

Attached to the suspension assembly 112 of loading apparatus 110 is a support assembly, generally indicated by the numeral 120. As shown, the support assembly 120 is generally horizontally disposed and is attached to and extends in two directions from the anchor block 114. As shown, the support assembly 120 has a support bar 121 which extends laterally to either side of the anchor block 114. Although the support bar 121 could be of various crosssectional configurations, an elongate tubular member may be employed. Positioned at the axial extremities of the support bar 121 are upstanding handles 122, which may be affixed to perpendicularly oriented mounting rods 123. The mounting rods 123 may conveniently be cylindrical tubes which telescopically interengage with the support bar 121 as depicted in FIG. 6 of the drawings.

The chuck assemblies 125 are positioned along support assembly 120 relative to suspension assembly 112 by chuck mounting blocks, generally indicated by the numerals 130 and 131. Variations in the distance between the axes of chuck assemblies 125, 125 are necessary for purposes of first facilitating the simultaneous pick up of spools S from a shipping container and second the simultaneous deposit of spools S on creel spindles from two chuck assemblies. In particular, the distance between the axes of spools S packed in a standard shipping container and the distance between the spindles of a creel are in most instances different. As indicated, expedited operation of the creel loading apparatus 110 requires that the distance between the two chuck assemblies be varied to displace the center line of chuck assemblies 125 selectively to the same two distances.

As shown, the mounting blocks 130, 131 may each consist of a slide block 132 and 133, respectively, which are positioned to either side of the anchor block 114 on the support bar 121 for selective slidable positioning axially of the support bar 121. It will be appreciated that the slide blocks 132, 133 may be provided with suitable bearings (not shown) for engaging the support bar 121.

Figure 8:
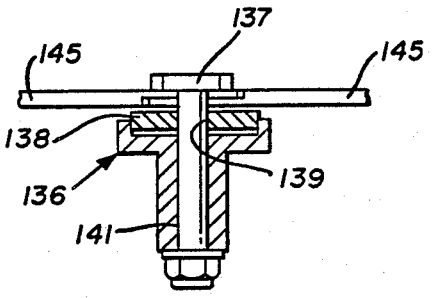
FIG. 8 is a fragmentary sectional view taken substantially along the line 8—8 of FIG. 6 and depicting details of a slide member which is actuated to control the distance between the axes of the pair of chucks.

The movement of and distance between the slide blocks 132, 133 is controlled by a block positioning mechanism 135. Block positioning mechanism 135 includes a central pivot joint, generally indicated by the numeral 136, which is seen in FIGS. 6, 7 and 8. The central pivot joint 136 has as the main pivot member a bolt 137 which moves along a guide plate 138 and particularly a vertical slot 139 therein. The guide plate 138 is offset from but preferably generally parallels the link bar 113. As shown, the guide plate 138 may be offset by a suitable spacer 140. The pivot joint 136 may have a slide grip 141 encompassing a portion of the bolt 137 to provide a hand grip for manual movement of the bolt 137 vertically within the slot 139. The guide plate 138 may have an adjustable clamp bar 142 which can be variably positioned and retained at any desired location along the slot 139 by a machine screw 143 and bolt 144. The clamp bar 142 controls the extent of travel of the pivot joint 136 from the position depicted in FIGS. 6 and 7 vertically along guide plate 138 as restrained by the clamp bar 142 blocking the slot 139.

The block positioning mechanism 135 also includes a pair of interconnect links 145 which are freely pivotally mounted on bolt 137 of pivot joint 136 proximate one end thereof and have the opposite ends pivotally affixed to the mounting blocks 130, 131 as by bolts 146. It will thus be appreciated that the interconnect links 145 move the mounting blocks 130, 131 inwardly along support bar 121 toward the link bar 113 as the pivot joint 136 is moved upwardly in slot 139, as for example, to the chain line position 136' depicted in FIG. 6 of the drawings. In this manner, the center line spacing of chuck assemblies 125, 125 may be selectively varied between two positions determined by the length of interconnect links 145 and the position of clamp bar 142.

The chuck assemblies 125, 125 are pivotable about their respective axes by means of chuck rotating mechanisms 150 and 151 which interconnect each of the chucks 125, 125 with their respective mounting blocks 130, 131. The chuck rotating mechanisms 150, 151 may be identical, therefore only the mechanism 150 associated with mounting block 130 depicted at the right hand side in FIG. 6 is described in detail.

Each chuck rotating mechanism 150, 151 consists of a shaft 152, seen in FIGS. 6 and 7, which extends into and is suspended from the slide block 132. The shaft 152 has proximate its upper extremity a dowel pin 153 which extends diametrically through the shaft 152. The shaft 152 also extends through a circular detent 154 which is fixed in mounting block 130 and has an arcuate recess 155 in which the dowel pin 153 rides and defines the extent of pivotal travel of the shaft 152. The recess 155 may have spaced grooves 156 proximate the angular extremities of recess 155 of detent 154 such that the weight of the chucks 125 tends to maintain the dowel pin 153 seated therein in the absence of a positive and significant turning force applied to the shaft 152. The angular extent of recess 155 between grooves 156 may be approximately 45° or other appropriate angle. A 45° rotation of the chucks 125 relative to the mounting blocks 130, 131 is commonly appropriate to effect rotation from a spool loading position wherein rotation of the shoe assemblies relative to the arm assemblies can be effected as depicted in FIG. 6 to a position with the shoes rotated through 45° for purposes of fitting between and picking up spools S arranged in a standard shipping container.

The chuck rotating mechanisms 150 and 151 include a lift link assembly, generally indicated by the numeral 160. The lift link assemblies 160 consist of a rectangular vertically disposed link bar 161 which may be configured in a manner similar to and for purposes of effecting the same functions as the link bar 21 of lift link assembly 20 of the embodiment of FIG. 1 of the drawings. The lift bars 161 differ in that the upper extremity thereof interfits within a slot 162 in shaft 152 and is rigidly attached therein as by appropriate welds 63. It will thus be appreciated that the lift link assemblies 160 and thus the chucks 125, 125 are affixed to and rotate with the shafts 152 of the chuck rotating mechanisms 150, 151.

In order to effect the coordinated, equiangular rotation of the chucks 125, 125, the chuck rotating mechanisms 150 and 151 may include and be interconnected by a chuck rotation actuator, generally indicated by the numeral 165, as best seen in FIGS. 6 and 7. The chuck rotation actuator 165 is interconnected with the shafts 152 of the rotating mechanisms 150, 151 as by collars 166 which are non-rotatably attached to shafts 152 as by pins 167 extending through the collars 166 and shafts 152. The collars 166 have slots 168 which are adapted to receive projecting lever arms 170 which are affixed therein as by welds 169. The lever arm 170 for each of the shafts 152 is joined by connecting links 172. The connecting links 172 each have a radially outwardly projecting grip 173. The connecting links 172 are joined to the lever arms 170 as by appropriate screws 174. It will thus be appreciated that the actuation of the grips 173 of the connecting links 172 effects equal angular rotation of the lever arms 170 and thus of each of the shafts 152, 152 carrying the chuck assemblies 125, 125.

The chuck rotation actuator 165 of chuck rotating mechanisms, 150, 151 may advantageously be provided with a position biasing mechanism, generally indicated by the numeral 180. As seen in FIGS. 6 and 7, the positioning biasing mechanism 180 is associated with one of the lever arms 170 and its related slide block 133. The position biasing mechanism 180 has a housing 181 which is affixed to the slide block 133 as by a bracket 182. The housing 181 carries a plunger 183 which is downwardly biased as viewed in FIGS. 6 and 7 as by a spring (not shown). The plunger 183 carries a roller 184 which is therefore biased into engagement with a cam 185 which is affixed to the lever arm 170. As best seen in FIG. 6, the cam 185 has a pair of angular surfaces 186 to either side of a central flat or horizontal surface 187. The biasing of the wheel 184 when on the angular surfaces 186 tends to rotate the lever arm 170 and shaft 152 toward a rotational extremity where a groove 156 of the recess 155 is engaged by the dowel pin 153. Similarly, efforts to rotate shaft 152 and the dowel pin 153 carried thereby from a groove 156 are resisted to a controlled extent by the roller 184 progressing up angular cam surface 186 against increasing biasing force applied by the wheel 184.

The chuck rotation actuator 165 thus effects angular rotation of chucks 125, 125 by an operator grasping a grip 173 to one side of the support assembly 120 and a handle 122 to the other side of the support assembly 120 as viewed in FIG. 6. Angular movement to the other position is effected by grasping the other grip 173 and the other handle 122 to effect rotation of the chucks 125 to the other rotational position. While the aforedescribed mechanism contemplates a manual block positioning mechanism 135 and a manual chuck rotation actuator 165, it will be appreciated by persons skilled in the art that the movements contemplated could be effected by the incorporation of suitable electrical, hydraulic or pneumatic actuation devices.

In the instance of multiple chuck assemblies 125, as contemplated in the second embodiment of the invention, the number of manual motions required by an operator in performing the various hoist control functions as well as operating the block positioning mechanism 135 and chuck rotation actuator 165, make it desirable that an operator be provided with assistance in operating the latch link 45 associated with each chuck assembly 125. This assistance may be provided by installing a latch link biasing mechanism, generally indicated by the numeral 190.

Figure 10:
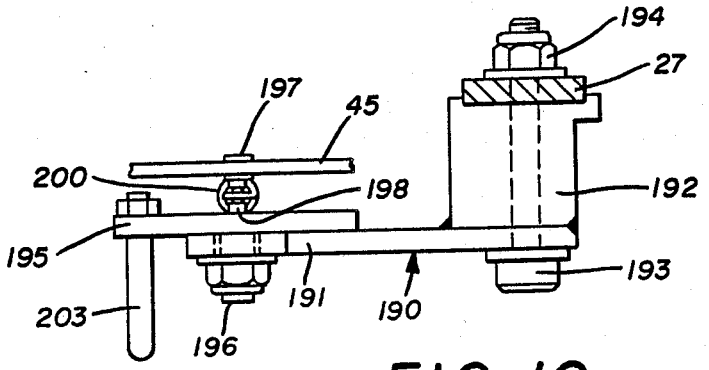
FIG. 10 is an enlarged top plan view of the directional latch actuator assembly depicted in FIG. 9.
Figure 9:
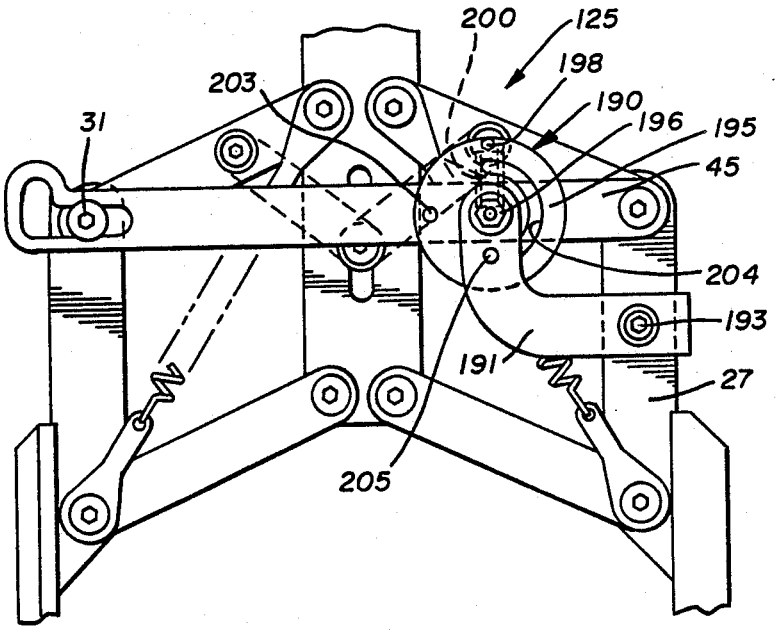
FIG. 9 is a front elevational view of a creel loading apparatus chuck comparable to that shown in FIGS. 1 and 6 but showing the chuck partially collapsed and showing a directional latch actuator assembly mounted in operative relation to the latch link.

As seen in FIGS. 9 and 10, the latch link biasing mechanism 190 is operatively interconnected between an arm link 27 and the latch link 45 of each of a plurality of chuck assemblies 125. The latch lock biasing mechanism 190 has as a primary structural member a locating arm 191 which is rigidly affixed to the arm link 27 as by a set off bracket 192, the set off bracket 192, arm link 27 and locating arm 191 being coupled by a bolt 193 and nut 194 as best seen in FIG. 10. The locating arm 191 rotatably mounts at the end opposite arm link 27 a spring positioning wheel 195 as by a bolt 196. The bolt 196 is the pivot axis for the spring positioning wheel 195 and preferably substantially overlies the latch link 45 as seen in FIG. 9.

Underlying spring positioning wheel 195 on the latch link 45 is a projecting spring mounting pin 197. Projecting from the spring positioning wheel 195 at a position preferably proximate the radial extremity thereof is a second spring mounting pin 198. A tension spring 200 is mounted between the spring mounting pins 197, 198 and is therefore interposed between the spring positioning wheel 195 and the latch link 45. The positioning of the spring relative to the latch link 45 may be varied from the vertically upward position depicted in FIG. 9 to a vertical downward position by the rotation of the spring positioning wheel 195 and the spring mounting pin 198 carried thereby. The spring positioning wheel 195 may be rotated by a wheel rotating handle 203 which projects outwardly as seen in both FIGS. 9 and 10. The extent of rotation of the spring positioning wheel 195 may conveniently be controlled to provide the aforesaid spring positioning by means of a rotation limiting slot 204 in the spring positioning wheel 195 which is engaged by a fixed stop pin 205 which projects from locating arm 191.

It will thus be appreciated that when the tension spring 200 is in the position depicted in FIG. 9, an upward biasing force tending to overcome gravity will be placed on the latch link 45 tending to move the latch link so the bolt 31 is in the horizontal portion of the slot 46 to permit the chuck assembly to close upon spool S. When the spring positioning wheel 195 is actuated by an operator grasping the wheel rotating handle 203 and rotating it clockwise through 180°, the slot 204 rotates relative to stop pin 205 until the opposite end of the slot is reached and the spring positioning wheel 195 is reoriented such that the tension spring 200 is directed downwardly from the mounting pin 197 on latch link 45. In this position, spring bias is provided to latch link 45 in a downward direction to assist gravity in moving the latch link 45 into the latched position depicted in FIG. 1, when the parallelogram linkages 26 assume a rectangular configuration. The wheel rotating handle 203 is actuated twice during an operating sequence preliminary to effecting the grasping and latching operations hereinabove described.

Thus it should be evident that the creel loading apparatus disclosed herein carries out the various objects of the invention set forth hereinabove and otherwise constitutes an advantageous contribution to the art. As may be apparent to persons skilled in the art, modifications can be made to the preferred embodiment disclosed herein without departing from the spirit of the invention, the scope of the invention being limited solely by the scope of the attached claims.

I claim:

1. A loading apparatus suspended by a cable for grasping a containerized spool, including strand material disposed thereon, transporting the spool to a position proximate a creel and orienting the spool for positioning on a creel spindle comprising, a plurality of substantially parallel arm means, shoe means carried by said arm means, gripping means on said shoe means for engaging the spool, lifting link means adapted for attachment to the cable, linkage means interposed between said lifting link means and said arm means and maintaining said arm means substantially parallel while bringing said gripping means into and out of engagement with the spool, and means pivotally mounting said shoe means relative to said arm means for selectively rotationally orienting the spool, said shoe means having a longitudinally elongate, laterally curved plate configured to circumferentially engage a portion of the circumference of the strand material on a spool and finger means projecting from the longitudinal extremities of said plate to engage radially outward extremities of flanges at the axial extremities of the spools.

2. A loading apparatus according to claim 1, wherein said means pivotally mounting said shoe means is a pivot pin.

3. A loading apparatus according to claim 1, wherein said arm means includes a pair of elongate arms positioned to engage diametrically opposite portions of the spool.

4. A loading apparatus according to claim 1, wherein the radially inner side of said plate has an elastomeric cover for engaging the strand material on a spool.

5. A loading apparatus according to claim 1, wherein said finger means at the lower longitudinal extremity of said plate retract longitudinally into said plate.

6. A loading apparatus according to claim 1, wherein said linkage means is a pair of parallelogram linkages, each mounting said arm means.

7. A loading apparatus according to claim 6, wherein spring means biases said parallelogram linkages toward maintaining a rectangular position thereof.

8. A loading apparatus according to claim 7, including latch link means for selectively locking said parallelogram linkages in the rectangular position out of engagement with the spool preparatory to grasping a spool in a container.

9. A loading apparatus suspended by a cable for grasping a containerized spool, including strand material disposed thereon, transporting the spool to a position proximate a creel and orienting the spool for positioning on a creel spindle comprising, a plurality of substantially parallel arm means, shoe means carried by said arm means, gripping means on said shoe means for engaging the spool, lifting link means adapted for attachment to the cable, linkage means interposed between said lifting link means and said arm means and maintaining said arm means substantially parallel while bringing said gripping means into and out of engagement with the spool, said linkage means being a pair of parallogram linkages, each mounting said arm means, means pivotally mounting said shoe means relative to said arm means for selectively rotationally orienting the spool, spring means biasing said parallelogram linkages toward maintaining a rectangular position thereof, latch link means for selectively locking said parallelogram linkages in the rectangular position out of engagement with the spool preparatory to grasping a spool in a container and biasing means selectively alternatively urging said latch link means into a locking position and into an unlocking position.

10. A loading apparatus according to claim 1, including catch means tending to maintain said shoe means aligned with said arm means.

11. A loading apparatus suspended by a cable for grasping a containerized spool, including strand material disposed thereon, transporting the spool to a position proximate a creel and orienting the spool for positioning on a creel spindle comprising, a plurality of substantially parallel arm means, shoe means carried by said arm means, gripping means on said shoe means for engaging the spool, lifting link means adapted for attachment to the cable, linkage means interposed between said lifting link means and said arm means and maintaining said arm means substantially parallel while bringing said gripping means into and out of engagement with the spool, means pivotally mounting said shoe means relative to said arm means for selectively rotationally orienting the spool, and catch means tending to maintain said shoe means aligned with said arm means, said catch means including a biased roller mounted on said arm means and a detent having a depression on said shoe means, said roller engaging said depression when said shoe means is aligned with said arm means.

* * * * *